US010307626B2

(12) United States Patent
Snodgrass

(10) Patent No.: US 10,307,626 B2
(45) Date of Patent: Jun. 4, 2019

(54) SOIL-BASED FIRE SUPPRESSION SYSTEM

(71) Applicant: Gary Brian Snodgrass, Las Vegas, NV (US)

(72) Inventor: Gary Brian Snodgrass, Las Vegas, NV (US)

(73) Assignee: Gary Brian Snodgrass, Las Vegas, NV (US)

( * ) Notice: Subject to any disclaimer, the term of this patent is extended or adjusted under 35 U.S.C. 154(b) by 1 day.

(21) Appl. No.: 15/293,596

(22) Filed: Oct. 14, 2016

(65) Prior Publication Data

US 2018/0104520 A1 Apr. 19, 2018

(51) Int. Cl.

| | |
|---|---|
| ***A62C 31/00*** | (2006.01) |
| ***A62C 31/02*** | (2006.01) |
| ***A62C 3/02*** | (2006.01) |
| ***A62C 31/28*** | (2006.01) |
| ***A62C 99/00*** | (2010.01) |
| ***B05B 7/14*** | (2006.01) |

(52) U.S. Cl.

CPC ..... *A62C 31/02* (2013.01); *A62C 3/0207* (2013.01); *A62C 3/0292* (2013.01); *A62C 31/28* (2013.01); *A62C 99/0045* (2013.01); *B05B 7/144* (2013.01); *B05B 7/1486* (2013.01)

(58) Field of Classification Search

CPC . A62C 99/0045; A62C 3/0292; A62C 3/0207; A62C 31/02; A62C 31/28; B05B 7/144; A01C 3/066; E01C 19/202; E01C 19/203; E01H 10/007

USPC ..... 239/689

See application file for complete search history.

(56) References Cited

U.S. PATENT DOCUMENTS 4,410,045 A * 10/1983 Whitman ..... A62C 31/24 169/24
5,361,988 A * 11/1994 Nelson ..... B60B 39/06 198/676
2014/0124224 A1* 5/2014 Berghuijs ..... B01D 46/0093 169/70

FOREIGN PATENT DOCUMENTS

CN 103736226 A * 4/2014 ..... A62C 3/02

* cited by examiner

*Primary Examiner* — Arthur O. Hall
*Assistant Examiner* — Tuongminh N Pham

(57) ABSTRACT

Implementations are disclosed herein that relate to a fire-fighting system. An example provides a firefighting system comprising a conveyance configured to receive and elevate screened soil, a chute configured to receive the screened soil at an entry point, and a nozzle configured to emit the screened soil toward a fire site, the nozzle comprising an augmentation device configured to increase a flow speed of the screened soil.

14 Claims, 9 Drawing Sheets

SOIL-BASED FIRE SUPPRESSION SYSTEM

FIELD OF THE INVENTION

The present invention relates generally to fire suppression, and more particularly to a system for suppressing fires using soil.

BACKGROUND

Fires are a common phenomenon in the environment, and arise from natural causes such as lightening, or human interactions that are negligent or deliberate (e.g., arson). Many fires pose great danger with respect to human life, property damage, and environmental damage, and often spread if left unattended. For those and other reasons, fires often necessitate human intervention to achieve their suppression or extinguishing. The dangers are much worse in forest fires where temperatures can reach over 1400 degrees Fahrenheit. These forest fires can pose grave danger to firefighters, and can melt vehicles and equipment as far away as 50 feet and can cause ignition of equipment, especially vehicles, up to 100 feet away.

A variety of approaches to fire suppression have been developed. Many approaches involve deploying a plurality of trained firefighters, specialized equipment (e.g., fire trucks, helicopters and/or other aircraft), and extinguishing chemicals and/or water. As such, the monetary and logistical cost of firefighting can be staggering. These and other issues may be exacerbated by the scarcity of firefighting resources and/or the increasing prevalence of environmental conditions (e.g., drought, climate change) that are conducive to fire. Characteristics of a site at which a fire burns may complicate fire suppression as well, such as its remote location (e.g., in the wilderness), low accessibility (e.g., high elevation, rough terrain), etc.

Even when successfully deployed to a burn site, a firefighting brigade may face factors which reduce its efficacy. For example, a tradeoff may be imposed between the ability to closely approach a fire yet maintain a sufficient distance to protect firefighters and equipment.

Several attempts have been made to resolve the problems stated above by using soil as a fire suppressant. However, these attempts have various limitations and problems. For example, some attempts require vehicles to be placed in dangerous proximity to a fire, (e.g., within 100 feet) require expensive and imported sand for operation, and are not able to project soil effectively. Specifically, the methods heretofore have not demonstrated the ability to move or project soil to distances beyond ten to twenty-five feet, which is not adequate to fight the fires safely. Patented references have disclosed inventions that 'throw or spray' soil rather than 'shoot, "propel, shoot or project" in a small-circumference, fast-moving steam, thus, those references do not show that their devices project soil far enough to keep personnel and equipment at a distance away from the extreme temperatures of wild fires and forest fires for safety, or to provide continuous, sustain operations of the firefighting systems or equipment. Equipment and methods must be developed for firefighting operators to bring soil to the fire rather than people and equipment to the fire. Therefore the soil must be shot in a high velocity stream, rather than thrown, sprayed or spread, to be successful in fighting such large fires. In addition, the inventions of the referenced patenentees do not provide systems or devices that will project soils to distances resulting in the extinguishing or suppression of fires in large areas. As an example, the larger the distance of soil projection, the larger the area (acreage) that can be extinguished, in a much shorter and critical time period, and lessons the need and frequency of redployment.

PRIOR ART

A. Nelson, U.S. Pat. No. 5,361,988 discloses a "material spreader", which is a vehicle-mounted system that "spreads" particulate material. Said material spreader is not configured or capable of "spreading" soil more than a few feet. The disclosure does not claim to project or shoot soil to a large distance and certainly has limitations determined by the design and configuration that prohibit the soil spreading to be accomplished with the accuracy and/or precision required for large, more distant fires. Further, the apparatus is vehicle-mounted, which precludes effective operation at forest fires or range fires.

B. Whitman, U.S. Pat. No. 4,410,045, discloses a Firefighting Vehicle comprising a vehicle (a pickup truck) with a tower mounted on the back that is equipped with a nozzle for spraying water (as stated in the detailed description) on a fire. The device is not designed or configured to shoot soil, and being vehicle-mounted, has the same limitations as other similar patents, specifically, it cannot operate within 50 feet and in some cases 100 feet of a forest fire.

C. Berjhuijs, U.S. Pat. No. 9,630,030B2, discloses an air cleaning system comprising a fire suppression component. The limitation of this system is that the fire suppression operates on the clean air within the enclosed system, which may be contaminated with combustible material. It is not applicable to fighting fires in the environment and could not be used on forest or rang fires.

D. Cai, U.S. Patent No. CN103736226, discloses a vehicle-mounted firefighting system. Its limitations, if it were to be used in a forest or range fire, are that it is vehicle-mounted and could not be used in close proximity such fires. Its operational capability is described as gathering soil (including rock), grinding the soil and rocks, conveying the soil to a small (approximately 15 foot high) tower, dropped about 3 feet to a funnel from which the soil (with rocks) is dropped (lowered) another 2 feet to a blower fan. The soil, with rocks, which may be ground or pulverized, is passed through said blower fan. There is no viable system or device disclosed which will consistently or assuredly produce or provide a screened or prepared soil product of a predetermined soil size range required for consistant propulsion of said soil. The blower fan "sprays" the soil on a fire, as disclosed. The blower fan, may be assisted with high-pressure gas injected into the stream. As stated in the detailed description, the soil is "sprayed onto the fire" (the term sprayed is used in the disclosure). This patent does not describe how, or to what extent the soil is "ground or pulverized) and it is unclear how soil, from the tower conveyer, will enter and effectively be sprayed onto the fire. The drawings indicate soil entering both sides of the blower fan which means the blower fan is moving soil in two directions, including in a direction against itself (e.g., against the intended direction of the firefighting soil), which severely lessens the effectiveness of the sprayed soil. Even if the invention is successful in spraying without a gravity assist and in the soil speed increase from spraying and the increase from the blower fan and compressed gas, this invention will only "spray soil at most, 25-30 feet. As an there would be a gravity assist of a total of 5.7 feet as indicated in the drawings, and calculating using the physics of falling bodies for a small drop from the pipe to the funnel. If the invention doubles the distance with the blower fan and doubles it again with the compressed gas, the invention may spray the soil to 28.5 feet. This distance is not close to meeting the needs for fighting forest fires and would not allow the vehicle on which this invention, as assembled and configured to operate in the fire zone.

As such, there exists a need for a firefighting system that can reduce the cost, complexity, challenges, and risks associated with traditional firefighting approaches.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a firefighting system, the firefighting system comprising, a soil processing and screening apparatus, said apparatus configured tp provide a predetermined optimally determined screened soil product, said firefighting system further comprising a conveyance system, configured to receive and significantly elevate and deliver said screened soil {sized soil of a specific soil particle size range determined by site conditions (e.g., of particle size between 0.05 mm and 0.5 mm or between 270 mesh and 35 mesh)} to an elevation sufficient that the soil will (in addition to the impact or action of other elements comprising said firefighting system) achieve adequate speed and momentum to shoot (propel or project) to a target area 50 to 1000 feet or more in distance away. Also disclosed are a nozzle to emit or shoot the soil at a fire site in a stream, a chute (a long hollow cylinder or channel), configured to receive the screened soil at an entry point, and further configured with up to 250 feet of length or more and further comprised of fire resistant, low-friction (smooth) material, such as steel, said low-friction configuration on the interior surface of said chute, to facilitate moving soil at high-speed as it drops in elevation, and which also may be configured, at its bottom end, to form part of a nozzle in a tapered configuration around an auger (e.g., the outer housing comprising said nozzle), such that the movement of the blades of the augur effectively move the soil forward and emit (project, propel or shoot) it from the exit point (opening) at the end of said nozzle. Also disclosed is a mechanical soil speed augmentation device comprising said nozzle and said auger, said auger comprising a solid steel auger body (solid cylinder, which, by definition, is a 3-dimentional geometric object that tapers smoothly from a flat circular bottom to a point called an apex or vertex)) with blades, said auger configured with blades either or integral to the body of the augur. Said blades are further configured at an angle to move soil under pressure to the forward end (end at which screened soil is emitted) to increase the flow speed of the screened soil, and further, to minimize the width or circumference of the soil stream (for efficient projection), to maximize the distance that the soil stream travels (is projected or shot) by reducing air resistance (drag), air turbulence and soil scattering.

In another aspect, the augmentation device mechanical soil speed augmentation device comprises an a nozzle and auger. The auger is designed and configured, uniquely, to propel or shoot soil forward rather than contemporary augers which push soil backward (toward the rear or upward). Typical augers, such as for example, excavation and boring augers (such as used in drilling wells), move the soil backward or upward out of an excavation or bore hole. This auger The auger of the present disclosure requires the special design of the blades, which must be configured at the correct angle (moving against the soil when the auger is rotating), as described above in {0008] and requires the special design of the bottom of the chute to completely and tightly fit around and enclose the auger blades {forming the housing (nozzle) around the auger}, said tight fitting configuration allowing sufficient and optimum clearance for soil movement, to further maximize the pressure, which maximizes the efficiency of the auger and the speed of the soil stream. Calculations for increasing the speed of the projected, screened soil have been carried out using a 500 horsepower engine to rotate the auger at the drive shaft at the point it connects to the auger.

In another aspect the nozzle the firefighting system comprises a gas soil speed augmentation device that selectively introduces pressurized gas into the nozzle above (prior to) screened soil entering the blades. Said soil speed gas augmentation device is selectively designed to introduce the gas at a point in the system at several points in the system that will not interfere with the soil moving through the chute or the nozzle. Furthermore, the gas supplied to the soil speed gas augmentation device is configured to introduce gas at several points around the circumference of the nozzle, pointing (directed) in the direction of the moving soil, to maximize the increase in the increase of soil speed. And configured with an aerodynamic design to minimize interference with the pathway of and flow of the screened soil.

In another aspect the nozzle a gas soil speed augmentation device comprises a tank holding the pressurized gas, or, comprises a motor, piping and a tank, said system with a one-way valve to assist in collecting and pressurizing the exhaust gas from said motor.

In another aspect, the firefighting system is collapsible in a manner that allows for rapid dismantlement of the, soil screening and processing apparatus, the conveyer, the chute, and the nozzle, a mechanical soil speed augmentation device, to facilitate quickly moving the firefighting system to another location for safety or for timely use in another location. The entire soil-based firefighting system, has components (e.g., the soil screening apparatus, the conveyance, the chute, and the mechanical soil speed augmentation), some of which are up to 250 feet in length and 20 feet in width or diameter, which pose immense problems and challenges for rapid dismantlement and re-deployment of the soil-based firefighting system. This is not a quick folding, vehicle-mounted system or other small piece of equipment that is easily maneuver and altered. The system cannot suffer twisted, bent, uneven or deformed parts, flanges or piece-to-piece misalignments. To ensure that such components, for example the conveyance and the chute, with daunting size and shapes, function without jamming and stoppages (the conveyance), or degraded or impaired soil flow from misaligned flanges or connections (the chute), dismantlement must be enabled with robust and easily employed quick-release connections and joints, This requirement results in the need to configure the equipment with robust and quick disconnecting features for better operation upon re-deployment and to speed up the dismantlement and redeployment operation so that the system can be quickly moved to another fire site. Such dismantlement and reassembly features and configurations may be configured with a host of quick disconnect and reattachment snap-connections and/or snap on/off connections.

In another aspect, the chute is uniquely configured to increase the speed of the screened soil by its smooth inner surface configuration, by its configuration to reduce elevation of the screened soil by gravity and by its forming of a tapered fit (tapered geometry) around the auger and auger blades, said chute forming the outer wall of the nozzle or to taper into a stand-alone nozzle.

In another aspect, the soil is emitted with force, increasing the speed it is propelled (i.e. projected or shot) in a solid soil stream at an exit point after passing the mechanical soil speed augmentation device (the auger and nozzle). Said force created by a rugged, solid steel auger, and further configured with solid steel auger blades which may include a spiral or helical configuration to maximize pressure on the screened soil against the nozzle, wherein release from the nozzle will result in depressurization resulting in increased screened soil speed.

In another aspect, a differential height between the entry point and exit point is between 20 feet and 50 feet 25 and 250 feet.

In another aspect, the conveyance comprises a conveyer belt machine, or conveyer device, configured with solid, continuous, sealed, leak-free, rigid containers, comprised of steel or other suitable material of strength, which minimize or eliminate spillage of soil, and further configured to tip, in order to deposit the soil into the chute entry point. Said conveyance may be combined with said soil screening and processing apparatus, configured with screens inside said containers of the conveyance.

In another aspect, a distance between the nozzle and the fire site is between 50 feet and 150 feet 50 and 1000 feet.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

The rotary projector is no longer contemplated.

Figure 1:
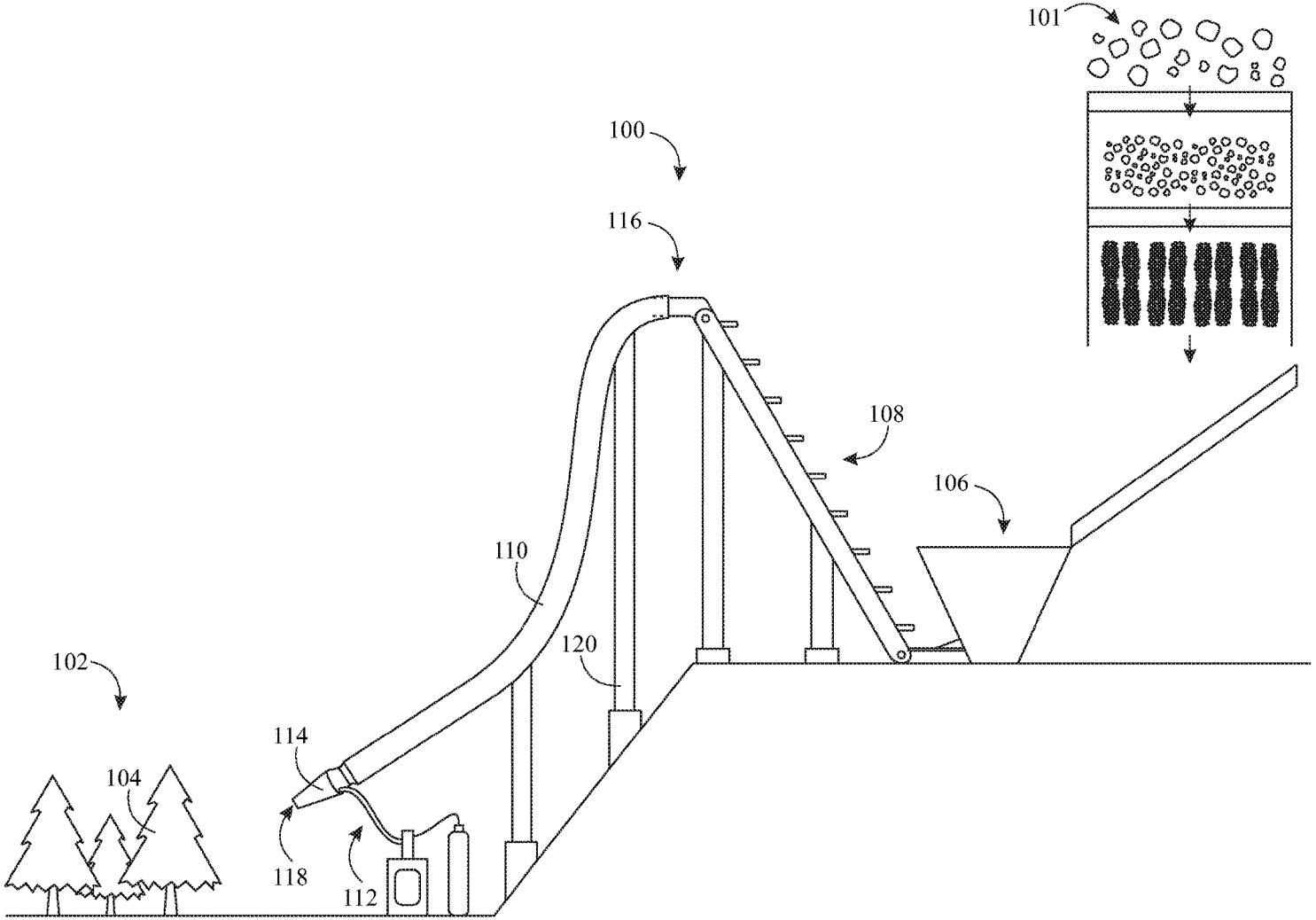
FIG. 1 presents an exemplary firefighting system, in accordance with aspects of the present disclosure.
Figure 7:
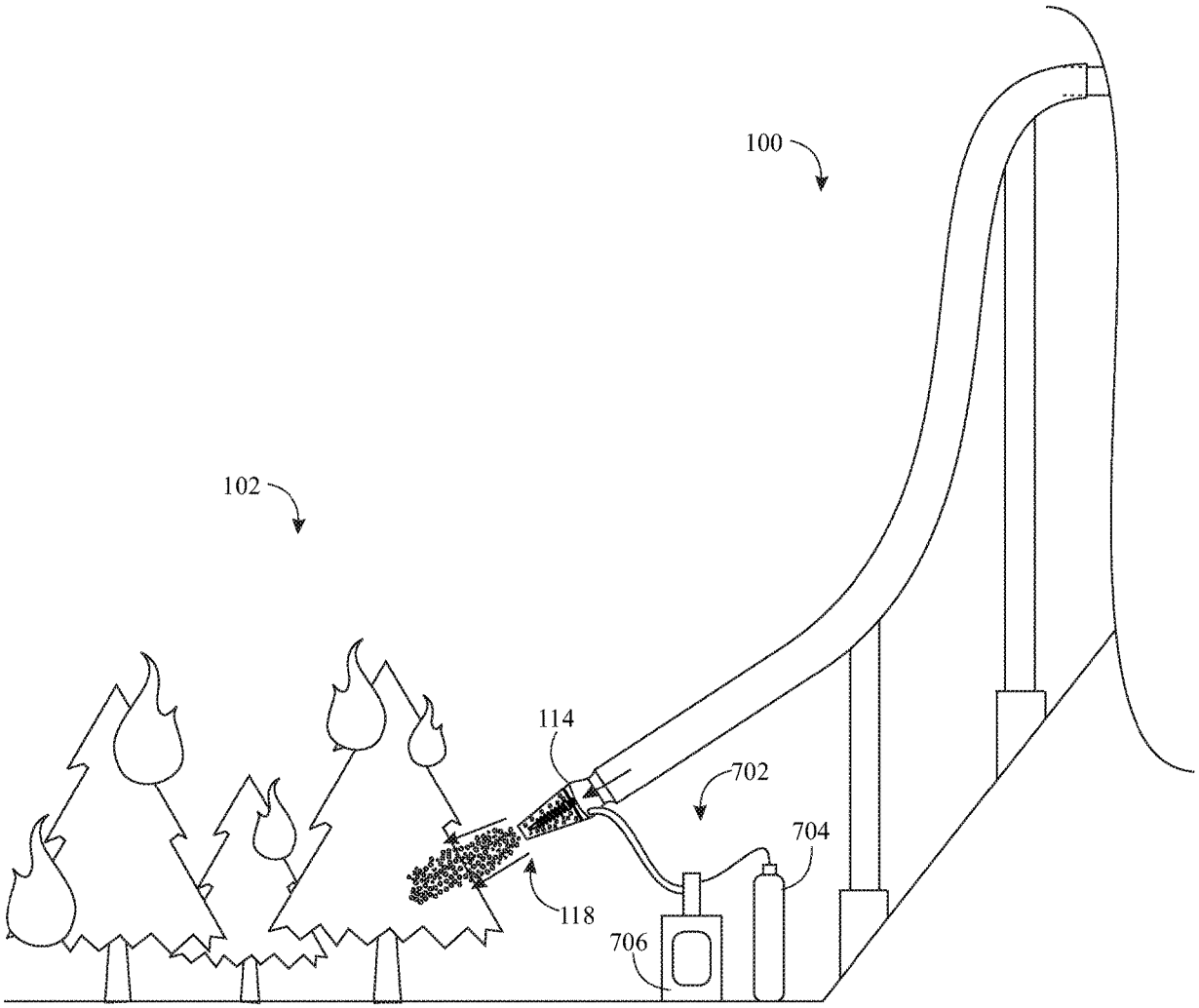
Figure 8:
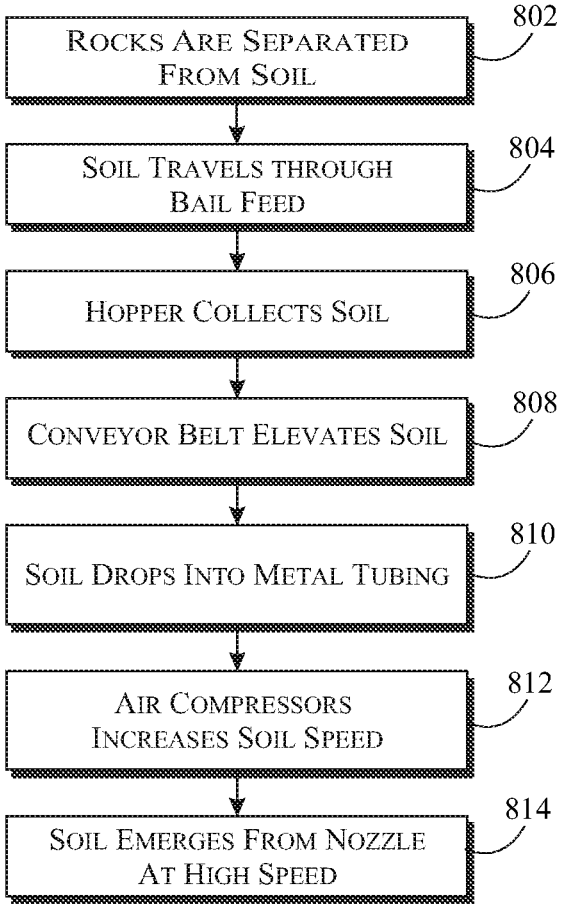
Figure 9:
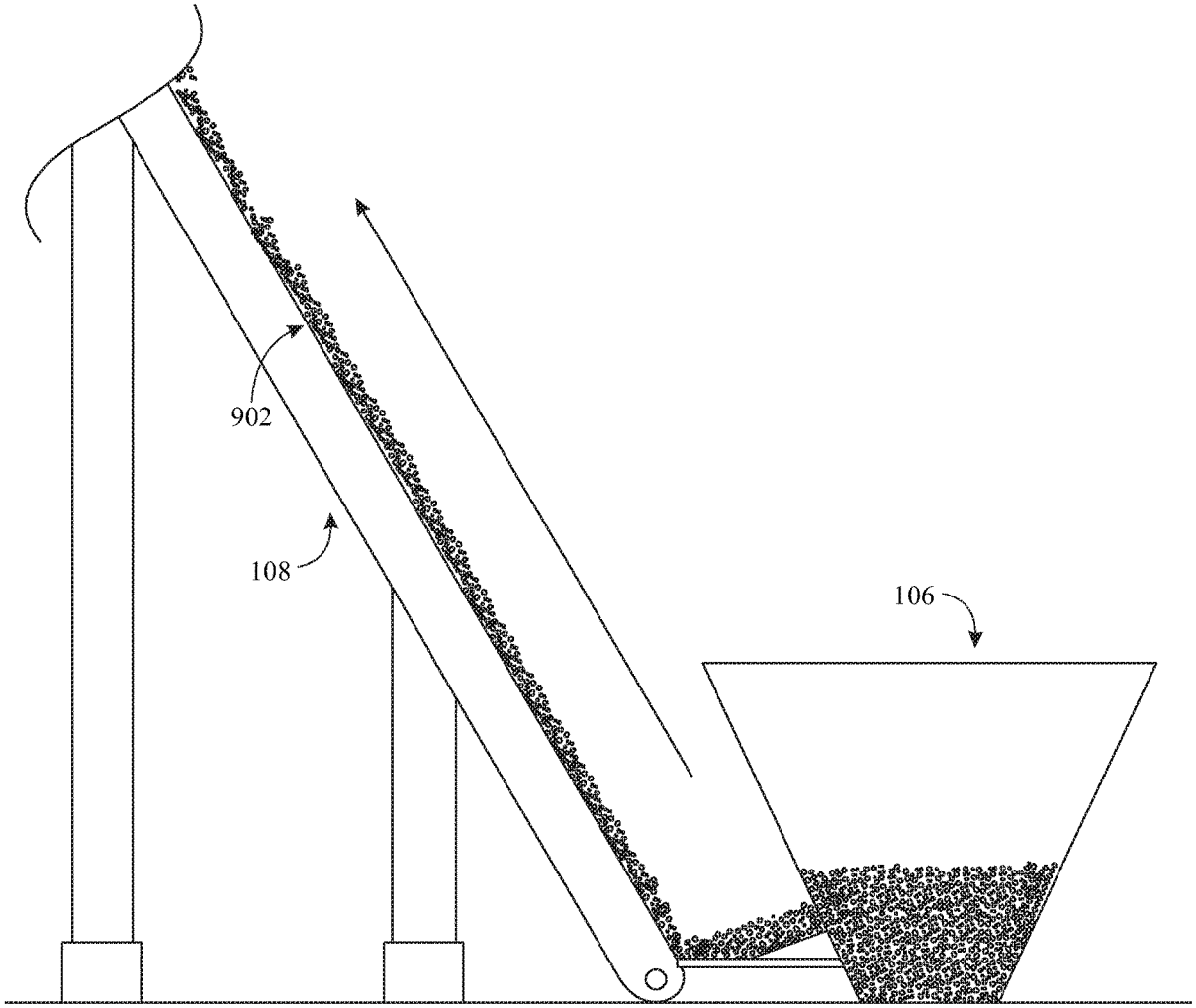

FIG. 7 presents a partial view of the exemplary firefighting system of FIG. 1 emitting screened soil toward a fire site, in accordance with aspects of the present disclosure;

FIG. 8 schematically presents an exemplary fire suppression method, in accordance with aspects of the present disclosure; and FIG. 9 presents an example of a continuous conveyance system, in accordance with aspects of the present disclosure.

It is to be understood that like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

DETAILED DESCRIPTION

Disclosed is a firefighting system. An example (FIG. 1) provides a firefighting system 100, comprising a soil screening and processing apparatus, wherein said apparatus employs a soil screening (sizing) and processing or cleaning (cleaning of organic matter and debris) method or process, configured with soil screening and separating devices configured in stages, said devices comprising metal frames between which are affixed metal screens, the stages of which are screens of decreasing size from the top (higher elevation) screens to the bottom (lower elevation) screens; said soil screening and processing apparatus configured to produce a specific soil particle size range determined by site conditions (e.g., of particle size between 0.05 mm and 0.5 mm or between 270 mesh and 35 mesh)} said particle size to augment (increase) the projecting of soil to a distance required by way of its optimum size and fliud-like consistency; said conveyance configured to elevate screened soil to an elevation which may be up to 250 feet, sufficient that the soil will (in addition to the impact or augmenting action of other elements comprising the firefighting system) achieve adequate speed and momentum to shoot (propel or project) soil to a target area 50 to 1000 feet or more in distance, said conveyance configured to receive and elevate screened soil (soil of a specific size range) and discharge, deposit or dump screened soil into a chute; a chute comprising a long tube or hollow cylinder, comprised of steel, configured with a smooth interior finish (surface) and further configured to receive the screened soil at an entry point and is further configured to have a tapered geometric shape (tapered at the bottom end), to form the outer housing of the nozzle and further configured with a steep angle or slope (having a steep slope or steep drop) of said chute (relative to horizontal) to maximize the effect of gravity to move soil at increased speed (flow speed) to a mechanical soil speed augmentation device. Further disclosed is said mechanical soil speed augmentation device, comprising an auger and a nozzle, said nozzle configured to emit (project, propel or shoot) the screened soil toward a fire site. Said fire site is more likely to be a large forest, range, or wild fire. Further disclosed is said auger comprising a conical solid steel body, configured with blades around the circumference of said auger, said blades configured at optimum angles to fit tightly or snugly yet with optimum clearance in a nozzle. Further disclosed is a nozzle comprised of strong steel, and configured to form-fit around the auger, said auger configured to rotate within the nozzle with power from an engine, creating pressure. Further, through release of pressure at the open end (emitting end) of said nozzle, flow speed of the screened soil will increase relative to the incoming screened soil speed (screened soil being fed to the auger). Further disclosed is that the optimum size of the screened soil from the soil screening and processing apparatus, and the configuration of the smooth interior and slope of the chute and its tapered geometry around the auger, and the optimum configuration of the auger and nozzle as disclosed above, the firefighting system as disclosed may function optimally from the collective function of all optimized elements and configurations. Further disclosed is that the conveyance is configured to hold an appropriate quantity of soil for the requirements of the system to deliver (propel, project or shoot) continuous screened soil to the fire site and to minimize spilling which can jam equipment. The system cannot stop delivering screened soil or firefighting will be interrupted causing safety problems. Paramount is that the soil-based firefighting system is not a typical firefighting system, not a typical soil handling operation like a road repair function or rock yard and soil spillage must be absolutely minimized. The conveyance is further configured to tip into the chute and minimize spillage at the entry point of the chute. The chute is configured to receive soil, to move soil to the nozzle quickly, and is configured to taper around the auger forming the outer housing of the nozzle. The nozzle comprises a housing as described above and an augur with blades. The augur blades are comprised of strong steel and angled to move soil forward, rather than backward, (for example like well-drilling augers which move soil backward or up and out of the drill hole). The blades of said auger are configured at an angle optimum for moving soil forward at an increased speed relative to the speed of the entering screened soil (screened soil which drops through the chute), however the auger may have a number of configurations and can also be in the form of a helical or spiral blade which must also have the said spiral blades configured to move soil forward rather than backward and must be form-fitted to the nozzle.

The illustration of FIG. 1 presents an exemplary firefighting system 100. As schematically indicated at 101, firefighting system 100 is configured to receive screened soil that may be propelled at relatively high speeds and distances up to 1000 feet and accurately aimed at a fire site 102 (e.g., trees 104) in order to suppress and/or extinguish the fire. As used herein "soil" refers to a collection of environmental material, most predominantly native or local dirt, including material collected and screened (selectively processed to generate a specific, optimum, soil particle size or size range) collected from the fire site (site where firefighting system 100 is deployed). The soil may also be excavated and processed (screened) prior to a firefighting operation, from another location. Soil may include a variety of elements (e.g., minerals and organic matter) that is herein collectively referred to as soil. It is to be understood that if there is too much organic matter at the fire site 102, another location for collecting and processing soil may be selected (for example a proximate location having less organic matter). Furthermore, soil containing too much organic matter, particularly plant matter and small wood chips can be easily processed by using non-conventional blowing equipment to remove the organic matter prior to and/or after screening. By enabling the use of soil at a fire site for fire suppression, firefighting system 100 may reduce or eliminate costs and infrastructural requirements associated with fire suppression agents (e.g., water, chemical compounds and aircraft) and their collection, storage, use and transportation. It will be understood, however, that fire suppression agents other than soil may be used by, and in conjunction and in combination with soil, by firefighting system 100. Further, soil used by firefighting system 100 may be collected at or proximate to fire site 102 and/or other locations not proximate to fire site 102. Details regarding the collection and processing of soil are described below with reference to the illustration of FIG. 2.

Soil discussed in [0034] may be processed by separating large particles (e.g. rocks) and debris, said process to be called screening (e.g. resulting in screened soil). Screened soil may be fed to a reservoir 106 which in turn feeds the screened soil to a conveyance 108. The conveyance 108 is configured to lift the screened soil to a desired elevation, thereby imbuing the screened soil with gravitational potential energy which is converted to kinetic energy to raise the speed and momentum of the screened soil. The speed of the soil follows the formula of a falling body, specifically: V=Square Root of (2gD) where V equals final velocity of soil, g is the acceleration due to gravity {32 feet per (second squared)}, and D is the distance of the fall which in firefighting system 100 is up to 250 feet. This formula (calculated at 250 feet elevation above the elevation of the immediate site) results in the screened soil velocity of 122 miles per hour or more. Firefighting system 100 may, thus, be referred to as a "gravity-assisted" system. In this way, a concentrated and partially-pressurized and/or high-speed stream of screened soil can be supplied to fire site 102 for fire suppression therein. Once raised to the desired location by conveyance 108, the screened soil can be fed to a chute 110 in which the screened soil can travel to a relatively lower elevation while gaining speed and momentum via gravity. A augmentation system mechanical soil speed augmentation system comprising an auger and nozzle, generally indicated at 112, may complement the assistance provided by gravity by further increasing the speed and momentum of the screened soil stream. Details regarding various implementations of the mechanical soil speed augmentation system 112 are described below with reference to the illustration of FIGS. 5-7.

Following its interaction with the Mechanical Soil Speed Augmentation Device 112, comprising the auger and nozzle, the screened soil stream may pass through said nozzle comprising said auger, said nozzle, which may provide via tapering geometry around the auger, through a concentrated orifice through which the soil stream is emitted with high precision and accuracy, thereby reducing waste of soil, reducing scatter, and reducing turbulence and clouding of the soil stream, thus increasing the speed of the soil.

As an example, chute 110 may have a diameter between 6 inches and 2 feet 1 and 4 feet, a length (e.g., unfurled length) between 50 and 150 feet between 25 and 250 feet, and may be comprised of polished steel or other fire-resistant materials, and further configured to increase smoothness, e.g., further polished or treated. As another example, the differential height between an entry point 116 at which the screened soil enters the chute 110, and an exit point 118 at which the screened soil exits the nozzle 114, may be between 20 and 50 feet or between 10 and 100 feet may be between 25 and 250 feet. As yet as another example the distance between exit point 118 and where the screened soil exits the nozzle 114, and the point at which the emitted soil contacts locations at the fire site (e.g., trees 104) may be between 50 and 1000 feet. In this way, the screened soil may be emitted in a manner that accurately targets fires within the fire site, yet is at a distance away from fire site that sufficiently separates human operators, firefighters, and firefighting system 100 from the fire site—e.g., sufficient separation may be achieved from the high temperatures at the fire site, in particular. Any suitable dimensions, emission ranges, and material compositions are possible, however.

Firefighting system 100 may be collapsible to enable rapid, dynamic and reversible deployment to adapt to rapidly changing fire conditions. The illustration FIG. 1 presents a plurality of supports, such as, support 120 that are configured to stably support and suspend (for example vertically) portions of firefighting system 100, such as chute 110 and/or conveyance 108. Supports 120 may be collapsible via any suitable mechanism, including but not limited to being comprised of multiple sections that may be removably affixed to one another, and or having a telescoping configuration that is axially collapsible. As yet another example chute 110 may be may be configured with concertina-type hinge mechanisms to facilitate axial collapsing or snap connections to facilitate quick release and/or disconnection. As yet another example, conveyance 108 may be slidingly collapsible, for example, configured with a sliding or telescoping mechanism or as another example, sliding, collapsible tracks, a sliding collapsible base foundation, or snap connections which are quickly releasing or connecting connectors for large equipment. In this way, firefighting system 100 may be rapidly collapsible and re-deployable at a variety of fire sites having varying geographic properties (e.g., mountains, range areas) while supporting its removal from each of such fire sites and reuse across different fire sites, while maintaining required firefighting function and efficiency in each rapid deployment.

Figure 2:
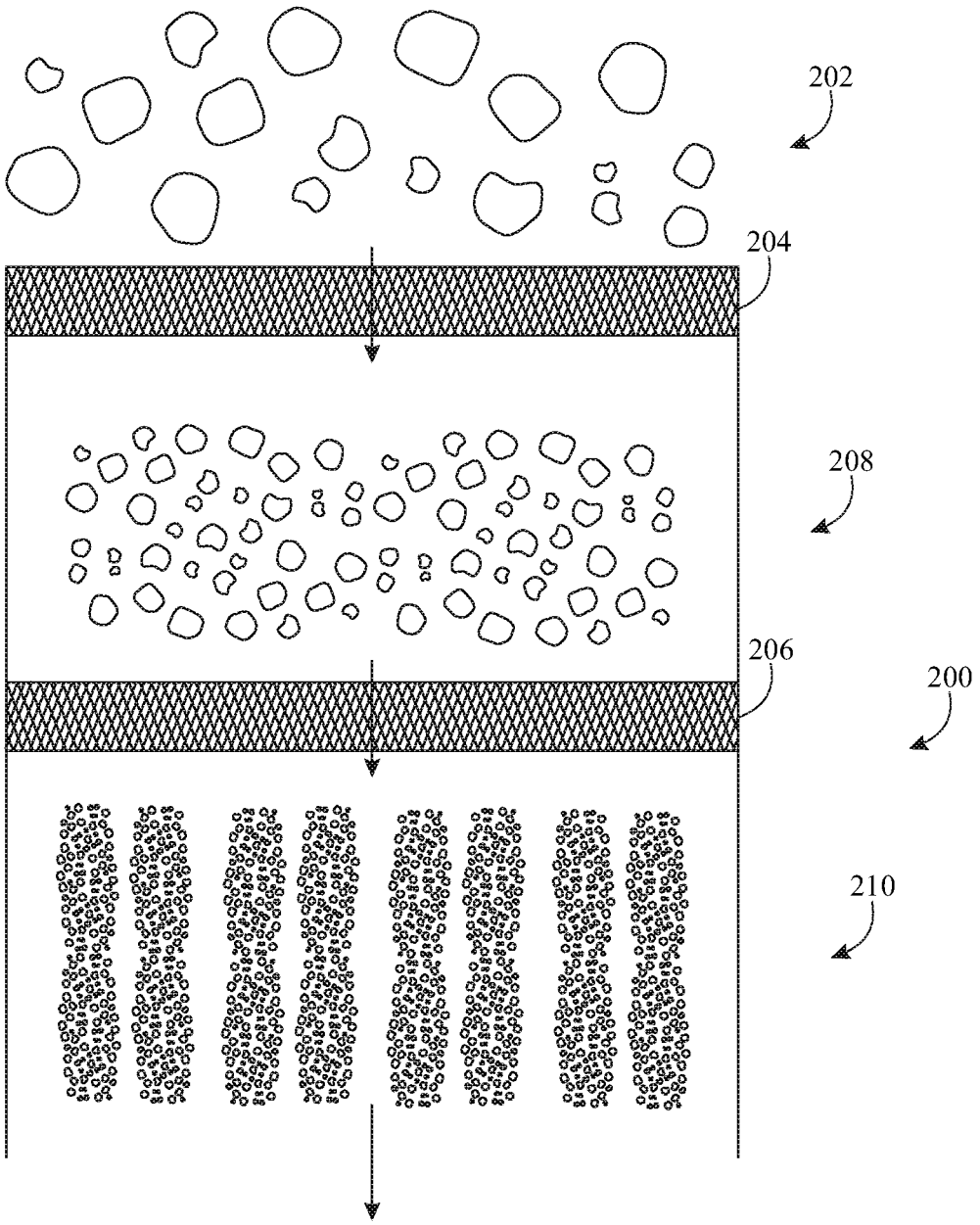
FIG. 2 schematically presents an exemplary soil screening process, in accordance with aspects of the present disclosure.

The illustration of FIG. 2 schematically presents an exemplary soil screening and processing apparatus, process 200. The soil process is essential to the success of the firefighting system 100 because debris and rocks are, historically a problem, causing lams, to mechanical systems and devices. The soil screening and processing apparatus and the soil screening function is planned and configured to produce a screened soil product that will result in continuous operation of the mechanical parts and, because of a smooth, fluid-like, rock-free screened soil, will enhance the capability of firefighting system 100 to project, propel or shoot screened soil to larger distances than unscreened soil. Process 200 may be employed to produce screened soil, processed soil (for example organic material rapidly removed) that can be fed to firefighting system 100 for operation at fire site 102. At 202, unscreened soil is supplied to a coarse screen 204. The unscreened soil may be unprocessed soil collected from fire site 102 or a location proximate to the fire site, for example, and may be collected via any suitable mechanism including but not limited to collection by heavy equipment such as a backhoe, earth mover, etc. Coarse screen 204 may substantially filter out soil particles above a certain threshold to produce coarsely-screened soil, which is then supplied to a fine soil screen 206 and 208. Fine soil screen 206 filters the coarsely-screened soil from the finely-screened soil at 210. The finely-screened soil may then be supplied to the firefighting system 100 as described in further detail below with reference to the illustration of FIG. 3. It will be understood, however, that process 200 is provided as an example and various modifications are contemplated, such as modifying the number and type of screens or debris-removal devices employed in the process. Further contemplated is a screening device or apparatus incorporated into the moving receptacles of a conveyance.

The finely-screened soil may substantially include and/or exclude particles of various size ranges. As one example, the screened soil may substantially include soil particles less than 2.0 mm (e.g., average diameter). As another example, the finely-screened soil may substantially include particles (or discard) as small as 0.02 mm (e.g., fine soil and silt) and up to 0.10 mm (e.g., moderately sized sand), and/or up to 1.0 mm (e.g., large sand and soil particles). It will be understood that the size of finely-screened soil produced via process 200 may vary with various environmental conditions, such as moisture, clay content, density and/or mineral content. Further, while not depicted in the illustration of FIG. 2, process 200 may employ additional or alternative components, such as grinders, atomizers, vibrators, vacuums, etc., and/or may include pathways for separately routing particles of different size ranges e.g., to eject excessively large particles to a location outside the area in which the soil is collected for screening via the process. For example, one or more of the screens shown in FIG. 2 may be vibrated or shaken such that the soil properly filters through the screens, and such that blockage at the screens is reduced. In another example, screens would be affixed within the moving containers is comprised with a pathway out of the container (car or receptacle) and to the side out of the container. Also, a blower may be used to remove leaves and other light-weight debris. The processing and production of screened soil depends on planning, calculating and determining the appropriate and most-effective soil particle size requires for maximum screened soil projection and propulsion. The fluid-like movement is necessary for such effectiveness, This is not a trivial and certainly not an obvious application of the art.

Process 200 may enable continuous production of screened soil that can be sufficiently used by firefighting system 100 to suppress fire without degrading the firefighting system in an interrupted manner. The uninterrupted provision of screened soil may be advantageous, as the interruption of fire suppression can severely inhibit firefighting—e.g., interruption caused by excessively large debris or particles that might otherwise be fed to firefighting system 100. Instead, process 200 enables the provision of so-called "pre-screened" or "pre-sized" soil to firefighting system 100 with undesirable particles, rocks, debris, and the like removed.

Figure 3:
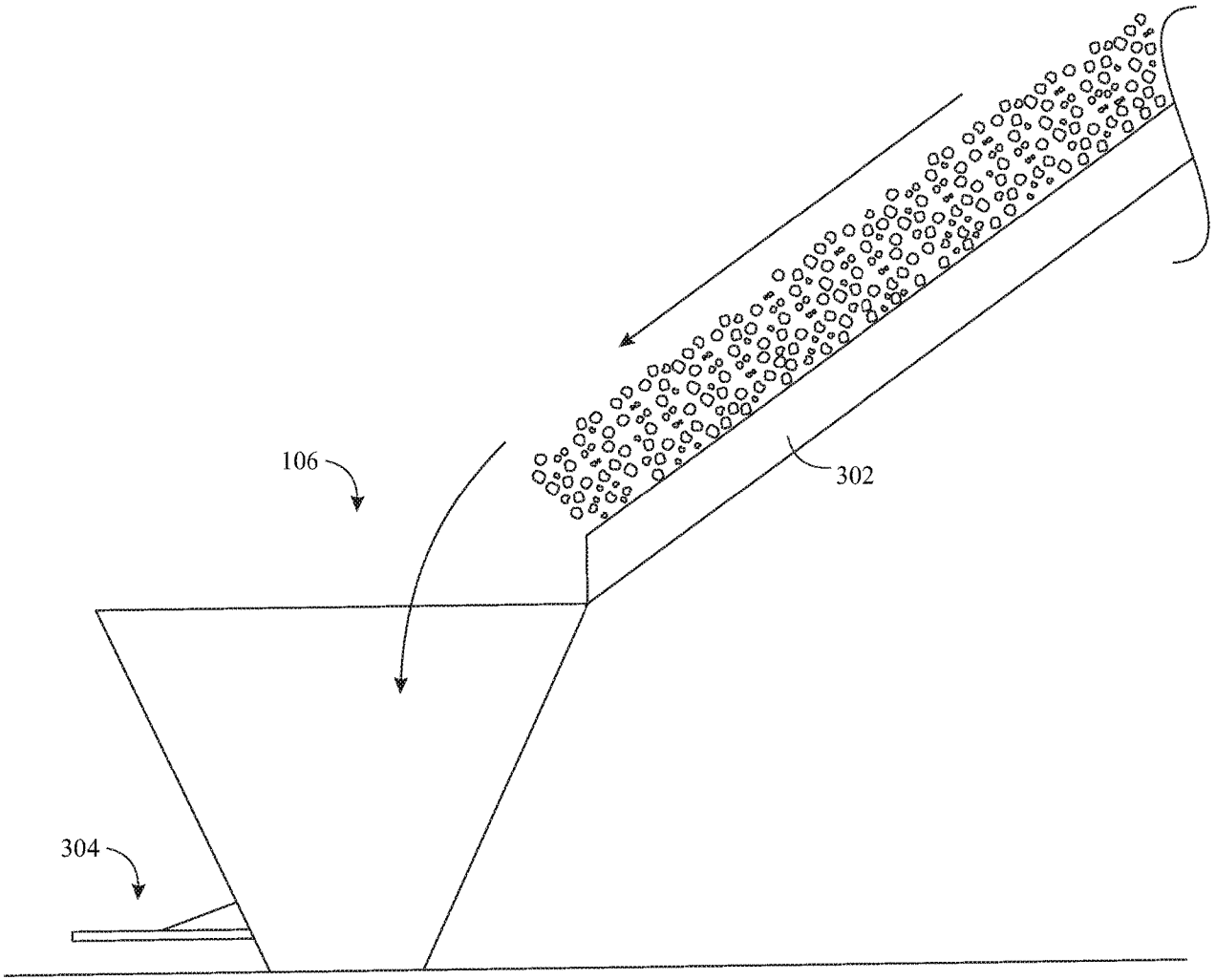
FIG. 3 presents an example of supplying screened soil to the exemplary firefighting system of FIG. 1, in accordance with aspects of the present disclosure.

The illustration of FIG. 3 presents an example of supplying screened soil to firefighting system 100 of the illustration of FIG. 1. Process 200 of the illustration of FIG. 2 may be used to produce the screened soil, for example. The screened soil is conveyed downwardly via a slide 302 into reservoir 106, which may be a hopper, for example. Reservoir 106 may exhibit a tapered shape and includes a collapsible door 304 through which screened soil collected in the reservoir can be supplied to conveyance 108 as further shown in the illustration of FIG. 4. Reservoir 106 may be endowed with any suitable mechanism to enable the supply of screened soil to conveyance 108, however.

Figure 4:
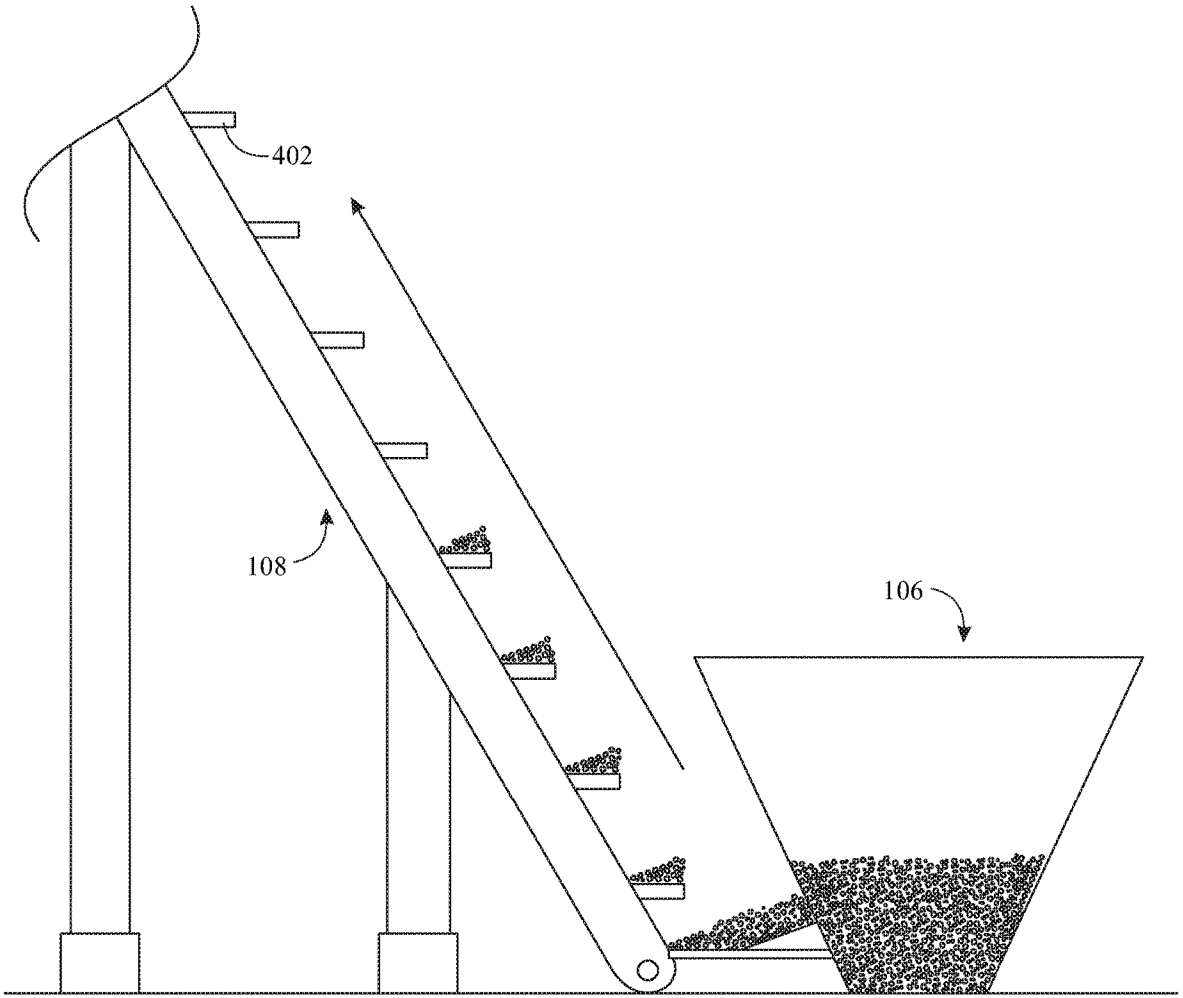
FIG. 4 presents an example of supplying screened soil from a reservoir to a conveyance of the firefighting system of FIG. 1, in accordance with aspects of the present disclosure.

The illustration of FIG. 4 presents an example of supplying screened soil from reservoir 106 to conveyance 108. As shown therein, conveyance 108 may assume the form of a conveyor belt, but other suitable forms are contemplated. Conveyance 108 may include a plurality of steps such as step 402 that are each operable to receive a portion (e.g., metered portion) of screened soil from reservoir 106 (e.g., via door 304) and raise the portion for supply to entry point 116 of chute 110 as shown in the illustration of FIG. 1. As yet another example in addition to those described above, conveyance may lift screened soil up to 250 ft (e.g., from the height at which it is received from reservoir 106). It is to be understood that conveyance 108 may omit the steps 402 without departing from the spirit and scope of this disclosure. For example, FIG. 9 shows conveyance 108 being configured to elevate and convey the soil via a continuous conveyor 902 such that soil can be continuously fed to the conveyance and subsequently to the entry point 116. As such, continuous conveyor 902 may include, or may be, a flat endless conveyor belt mounted on a roller assembly as known in the art of conveyor systems. For example, an upper conveyor belt contacting and carrying the soil may be translated upward while a lower conveyor belt (not in contact with the soil) is concurrently translated downward. The conveyor belt may be surrounded by lateral walls that keep the soil from spilling laterally off the conveyance 108.

Figure 5:
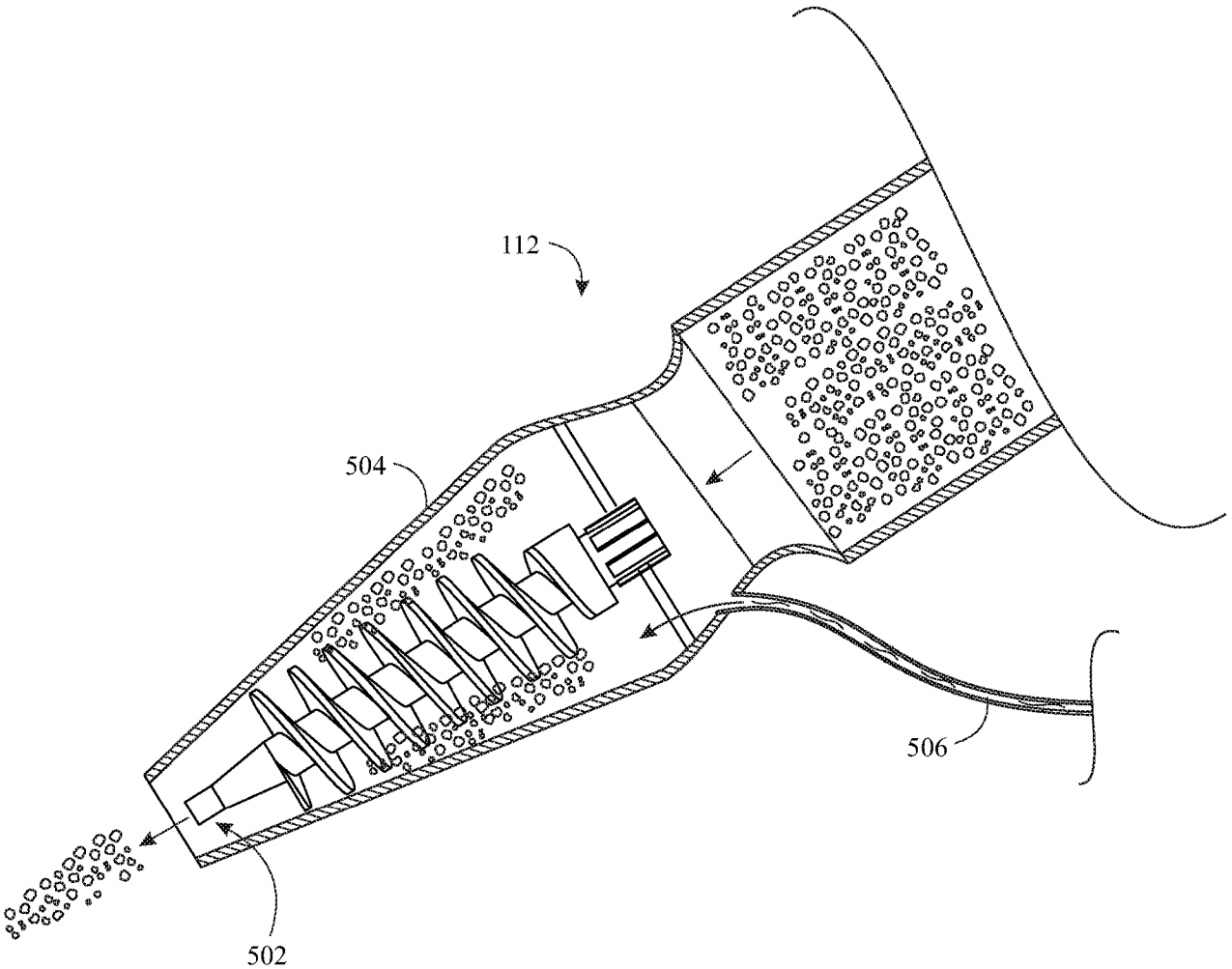
FIG. 5 presents a cross-sectional view of an exemplary implementation of a mechanical soil speed augmentation device comprising a nozzle and auger, which increases the speed or flow of the moving soil. Further the cross-section view of the nozzle with auger is taken along a longitudinal axis of said nozzle to show internal components of the mechanical soil speed augmentation device, i.e. the augur within the nozzle, in accordance with aspects of the present disclosure.
Figure 6:
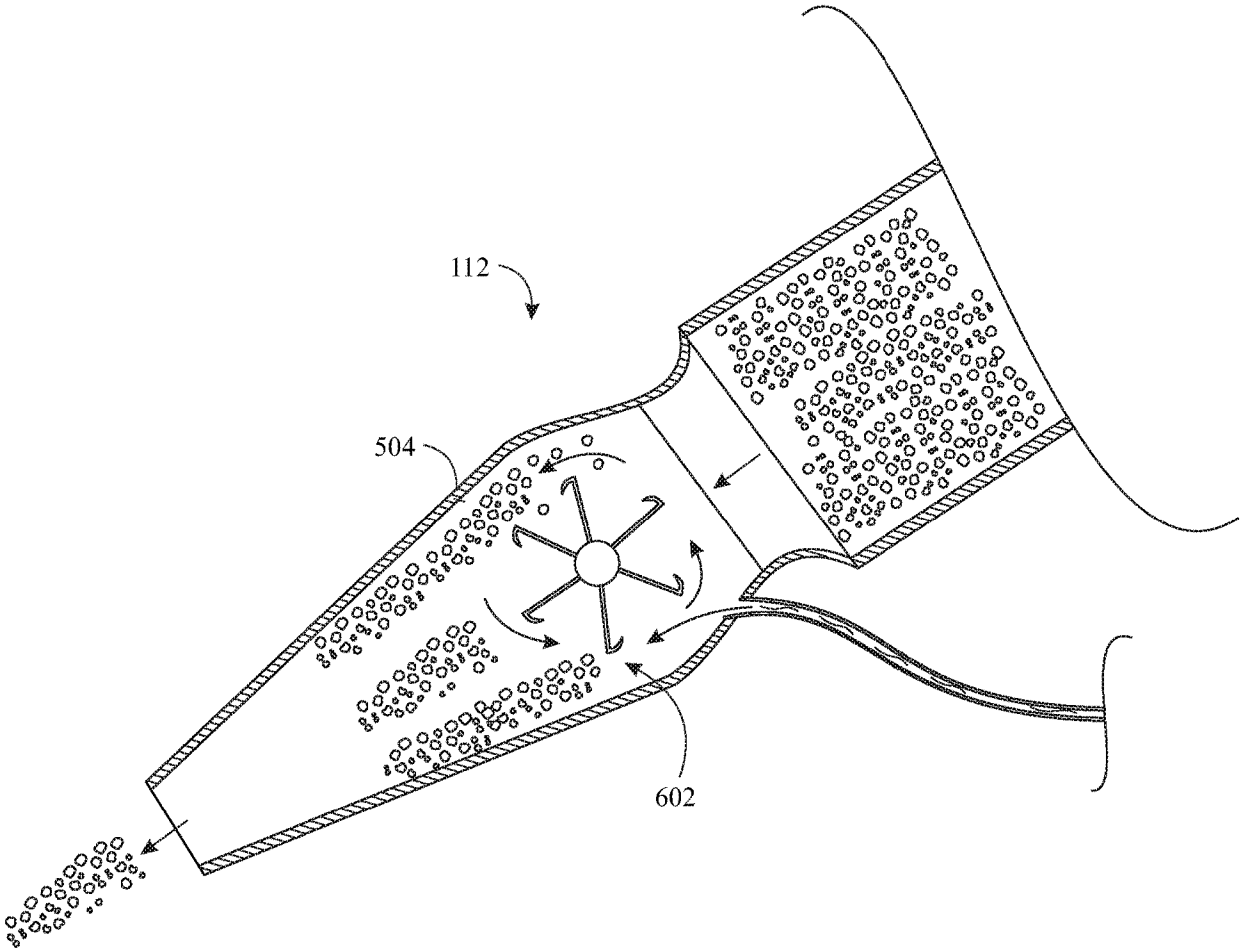

The illustration of FIG. 5 presents a cross-sectional view of an exemplary implementation of the mechanical soil speed augmentation device 112. As described above, the mechanical soil speed augmentation device 112 may be configured to complement the gravitational assistance afforded by chute 110 to the speed and momentum of screened soil flowing therein. The illustration of FIG. 5 particularly shows an example implementation of a mechanical soil speed augmentation device 112 in the form of an auger 502 arranged in a housing 504 and configured either via an independently constructed device (nozzle) or a continuation of the chute 110, or by a tapering around the auger and blades, said nozzle housing (which can be the lower extension of the chute) and configured to emit (project or shoot) screened soil through a nozzle 114 and an exit point 118. Auger 502 may include a plurality of helical blades, attached to and axially spaced along a drive shaft, and may allow screened soil to flow proximate to the blade surfaces and between the blades and drive shaft. In this way, the resistance to screened soil can be minimized, or optimized, and can enhance the pressure pushing the soil forward and thus the soil flow (soil speed) maximized. Auger 502 may be comprised of any suitable material(s) such as steel or various other metal alloys, and may have blades whose angles and/or dimensions are specifically configured to move screened soil forward at appropriate rates given various rotational speeds of the auger and forces driving the auger and soil densities, in contras. Screened soil densities will also be a factor in the speeds of the auger. The configuration of the firefighting system 100 auger is in contrast and differs from standard off-the-shelf or original equipment manufacturer (OEM) augers and blades developed in the mining and excavation industries, in that it moves soil forward rather than backward. Further, the blades of the auger are configured to maximize the flow speed of the screened soil by their optimized angle, and their optimized spatial clearance within the nozzle housing. Auger 502 may be operatively coupled with a suitable device such as an engine to enable and enhance rotational blade motion.

The illustration of FIG. 5 also presents the inclusion of gas soil speed augmentation device in 112. In particular, a partial view of a gas line 506 is shown by which a suitable pressurized gas may be supplied to the interior of housing 504 to increase the flow of screened soil through nozzle 114. The gas soil speed augmentation device may be used alternatively or in addition to augur 502 or other mechanical soil speed augmentation device described below. Various suitable gas(es) may be supplied via gas line 506, including but not limited to carbon dioxide, nitrogen, and air, some of which may aid in fire suppression. Carbon dioxide, for example, may aid in fire suppression and may be produced from a variety of sources at low cost. Further, carbon dioxide can be collected, pressurized and stored in a pressurized tank, or from motor-operated machinery on site, including a motor operating the auger and/or conveyer systems. Regardless of the particular gas(es) employed, the gas(es) may increase the screened soil flow by separation of soils in the soil housing 504 and by introduction into the chute immediately prior to entering the nozzle or around the nozzle at an optimized point near the front (top) end of the auger. The gas(es) may be introduced in a series of pressurized gas lines arranged around the circumference of the chute immediately prior to the nozzle. The gases introduced in this fashion around the chute 110, will better facilitate speed augmentation (increase) of the screened soil and will reduce clogging of the chute 110 with injection tubes or jets which may be pointed in the direction of the movement of the screened soil, reducing turbulence and configured so as not to protrude into the pathway of screened soil movement. Additional details regarding the gas augmentation system are described below with reference to FIG. 7.

Alternative or additional mechanical implementations of the mechanical soil speed augmentation device 112 are contemplated. For example, an impeller may be used alternatively or in addition to augur 502, and may be of relatively smaller length, of relatively more robust construction, and/or may be more suited to denser soils and materials. As another example, a blade assembly similar to those used for blowing snow but having relatively thicker blades and/or having a relatively more advantageous or steeper blade angle may be used, which improve on the blade construction of, for example, blades similar to those used for blowing snow are contemplated. The blades would be improved to accommodate the density of screened soils, and the rotational drive mechanism would be gear or chain-operated to move the soil. A more severe (steeper), and more advantageous blade angle may be used for soils. As yet another example, two or more impellers may be employed with either a single nozzle or two or more nozzles (e.g., a respective nozzle foe each impeller). For implementation where two or more impellers are employed, chute 110 may be endowed with a relatively greater diameter and/or one or more blades positioned in the nozzle or in the chute or another soil-based firefighting system housing or device.

The illustration of FIG. 7 presents a partial view of exemplary firefighting system 100 emitting (projecting or shooting) screened soil toward fire site 102 to thereby suppress the fire therein. In particular the emission of screened soil from nozzle 114 at exit point is shown, a gas supply device 702 selectively supplying gas to the gas soil speed augmentation device described above and to the interior of nozzle 114. The supply of gas may be provided by on site motors or engines, for example the motors to operate the conveyance and/or the auger. Gas supply/control system

702 may include a gas reservoir 704, which may be a pressurized tank, and may include a pump and/or a suitable valve mechanism (e.g., a one-way valve) for enabling the selective supply of gas therein to the interior of nozzle 114. Gas reservoir 704 may feed gas to a control system 706, which may include various sensors and/or actuators for facilitating selective gas application. For example, control system 706 may include a pressure sensor and/or mass flow sensor for respectively measuring the pressure the pressure and/or mass flow of gas released from reservoir 704. In some examples, control system 706 may control the release of gas from reservoir 704, for example, by actuating the valve mechanism of the reservoir and/or by actuating its own valve mechanism. In some examples control system 706 may include an input device to enable human operation of the control system and selective release of gas from reservoir 704. Alternatively or additionally, control system 706 may include a communications subsystem for interfacing (e.g., via wired or wireless connection) with a remote computing or input device and receiving from the device, commands controlling gas supply. As such, control system 706 may include a computing subsystem to enable control, input, and/or communication for supplying gas.

The illustration of FIG. 8 presents an exemplary method 800 of fire suppression. Method 800 may be employed using firefighting system 100 of the illustration of FIG. 1, for example.

At 802, method 800 includes separating rocks from soil. The soil may be collected at a fire site or proximate the fire site. Rocks and/or other debris may be separated from the soil via process 200 presented in the illustration of FIG. 2, for example, and separation may include isolating particles of a desired size range. As such, screened soil may be obtained.

At 804, method 800 includes routing the screened soil through a bail feed. Slide 302 of the illustration of FIG. 3 may be used to route the screened soil, for example.

At 806, method 800 includes collecting the screened soil at a hopper. The hopper may be reservoir 106 of the illustration of FIG. 1, for example.

At 808, method 800 includes carrying the screened soil to high elevations via a conveyor belt. The conveyor belt may be conveyance 108 of the illustration of FIG. 1, for example.

At 810, method 800 includes dropping the screened soil into a metal tubing. For example, the screened soil may be supplied to chute 110 at entry point 116, both of the illustration of FIG. 1.

At 812, method 800 includes air-compressing the screened soil to increase soil speed. Air or any other suitable gas(es) may be used, which may be supplied via the gas augmentation system presented in the illustration of FIG. 7, for example, to increase the soil speed.

At 814, method 800 includes emitting the screened soil through a nozzle at relatively high speeds. The screened soil may be emitted from nozzle 114 at exit point 118, both shown in the illustration of FIG. 1, for example.

In view of the above, firefighting system 100 may provide a collapsible, dynamically deployable approach to suppressing and/or extinguishing fires by utilizing naturally abundant resources available at or proximate to a fire site. In this way, the cost, complexity, and risks associated with other firefighting approaches may be reduced.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A collapsible firefighting system comprising:

at least one screen configured to produce screened soil for firefighting;

a hopper receiving the screened soil from the at least one screen via a slide;

a plurality of individually collapsible and parallel vertical supports;

a continuous conveyor receiving the screened soil from the hopper, wherein the conveyor carries the screened soil to a higher elevation of at least 250 feet above the ground and deposit the screened soil directly into an entry opening of a chute, and wherein the conveyor and the chute rest on the plurality of individually collapsible vertical supports;

wherein the chute is made of steel;

a nozzle assembly comprising an auger inside a tapered nozzle housing, wherein the nozzle housing being directly connected to the chute, the nozzle housing configured to eject a flow of screened soil at an exit opening;

the auger comprising a plurality of helical blades axially spaced along a shaft;

a gas control system comprising a pressurized tank, a pressure sensor and a mass flow sensor for measuring a pressure and a mass flow of the gas released from the pressurized tank, respectively;

wherein the nozzle assembly is connected to the gas control system configured supplying pressurized gas directly into an interior of the nozzle housing to increase the flow of screened soil through the exit opening;

wherein the gas control system is directly connected to the nozzle housing via a gas line;

wherein the gas control system is configured to selectively supply gas to the interior of the nozzle housing; and wherein the conveyor rests on the plurality of individually collapsible vertical supports in an upward slope; and where the chute rests on the plurality of individually collapsible vertical supports in a downward slope toward a fire site.

2. The collapsible firefighting system of claim 1, wherein the vertical supports have different heights.

3. The collapsible firefighting system of claim 1, wherein the plurality of vertical supports comprise of multiple sections having a telescoping configuration that is axially collapsible.

4. The collapsible firefighting system of claim 1, wherein the plurality of vertical supports comprise of multiple sections, removably affixed to one another.

5. The collapsible firefighting system of claim 1, wherein the hopper comprises a collapsible door.

6. The collapsible firefighting system of claim 1, wherein the at least one soil screen comprises at least a coarse soil screen, and a fine soil screen.

7. The collapsible firefighting system of claim 6, wherein the at least one screen comprises a plurality of screens to provide screened soil particles of size between 0.2 mm and 2.0 mm.

8. The collapsible firefighting system of claim 1, wherein a differential height between the entry opening of the chute and the exit opening of the nozzle is between 25 and 250 feet.

9. The collapsible firefighting system of claim 1, wherein a distance between the nozzle housing and a fire site is between 25 and 200 feet or more.

10. The collapsible firefighting system of claim 1, wherein the auger is positioned adjacent the exit opening of the nozzle housing.

11. The collapsible firefighting system of claim 1, wherein the pressurized tank stores the gas being one of carbon dioxide, nitrogen, or air.

12. The collapsible firefighting system of claim 1, wherein the gas supplied to the nozzle housing increases the screened soil flow by separating the soil in the nozzle housing.

13. The collapsible firefighting system of claim 1, wherein the nozzle housing is connected to the chute at a proximal end opposite from the exit opening.

14. The collapsible firefighting system of claim 1, wherein the conveyor comprises a continuous belt.

* * * * *